United States Patent [19]

Graham et al.

[11] 4,422,844

[45] Dec. 27, 1983

[54] SNAP ACTING THERMOSTATIC FLUID VALVE AND ELECTRICAL SWITCH COUPLED THERETO

[75] Inventors: Marvin M. Graham, Westminster; Jay R. Katchka, Cypress, both of Calif.

[73] Assignee: Robertshaw Controls Company, Richmond, Va.

[21] Appl. No.: 229,517

[22] Filed: Jan. 29, 1981

Related U.S. Application Data

[63] Continuation of Ser. No. 935,165, Aug. 21, 1978, abandoned.

[51] Int. Cl.[3] ..... F23N 5/00; H01H 9/06

[52] U.S. Cl. ..... 431/72; 200/61.86; 236/15 A; 337/368

[58] Field of Search ..... 236/15 A, 33, DIG. 1, 236/48 R, 99 B; 337/368; 126/374, 351; 431/72, 256

[56] References Cited

U.S. PATENT DOCUMENTS

| | | | |
|---|---|---|---|
| 2,800,284 | 7/1957 | Weber et al. | 236/94 |
| 3,159,346 | 12/1964 | Caparone et al. | 236/48 R |
| 3,405,869 | 10/1968 | Grayson et al. | 431/256 X |

*Primary Examiner*—William E. Wayner

*Attorney, Agent, or Firm*—Fulwider, Patton, Rieber, Lee & Utecht

[57] ABSTRACT

A unitary assembly includes a thermostatically controlled valve and an electric switch coupled for operation therewith. Both the valve and the electric switch are operated under the control of a thermostatic actuator which effectuates operation through a snap acting member movable between alternate stable positions. Neither the valve nor the electrical switch can dwell at the threshold of actuation, but rather are positively actuated to either an open or closed position when the snap acting member moves to one of its stable positions, and to an opposite condition when the snap acting member moves to its alternate stable position. The movement of the thermostatic actuator can be adjustably multiplied by a lever arrangement in the valve housing. The movement of the snap acting member can also be multiplied by an internal arrangement employing a lever ring with radially inwardly directed cantilevered lever arms. The valve of the invention may be employed for direct actuation of ignition of a gas burner, for actuation to open a flue damper, and for actuating a burner and a blower in a forced air combustion chamber.

10 Claims, 9 Drawing Figures

FIG. 1
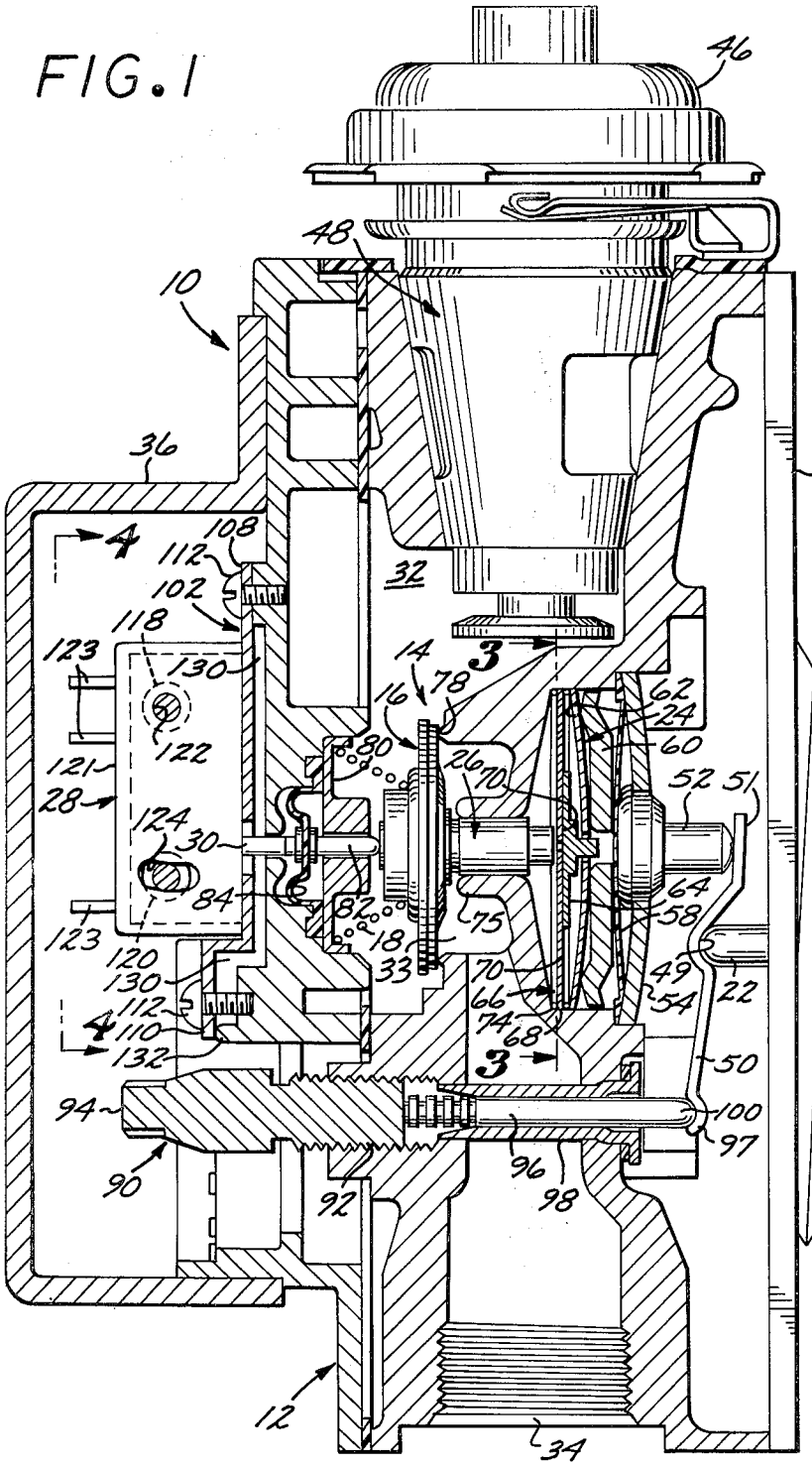
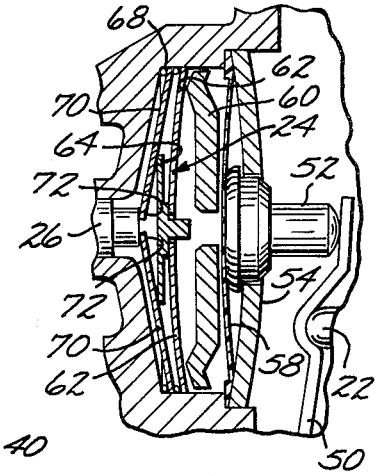
FIG. 2
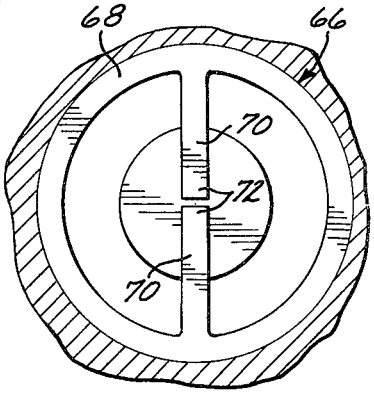
FIG. 3

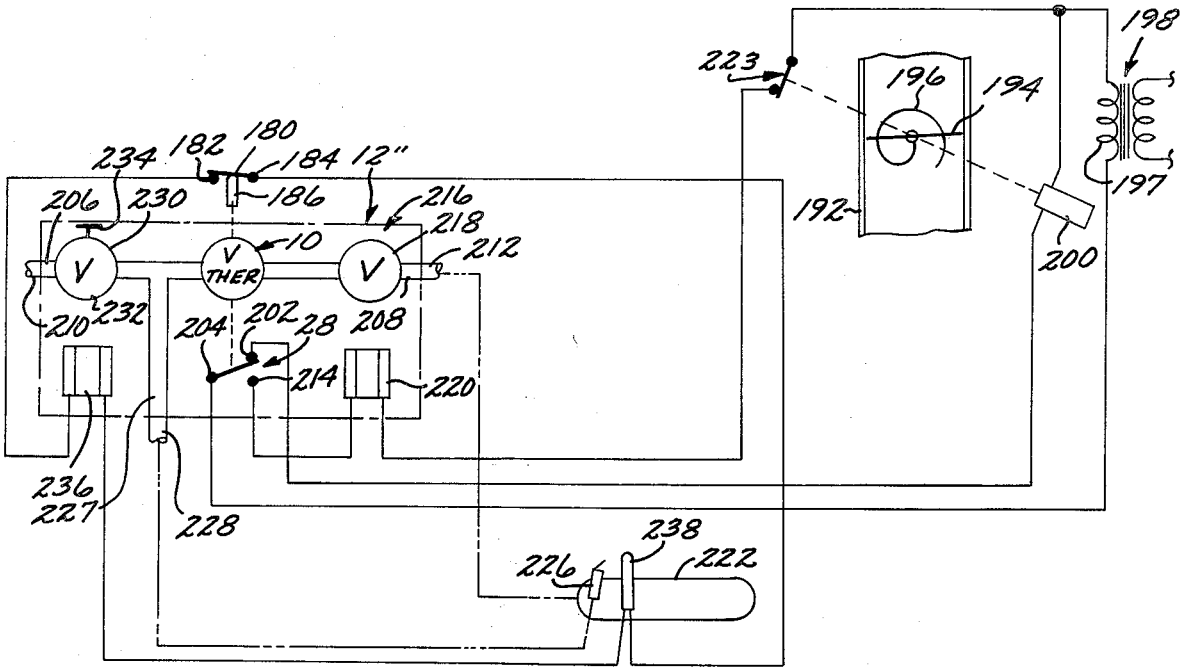
FIG. 8
FIG. 9
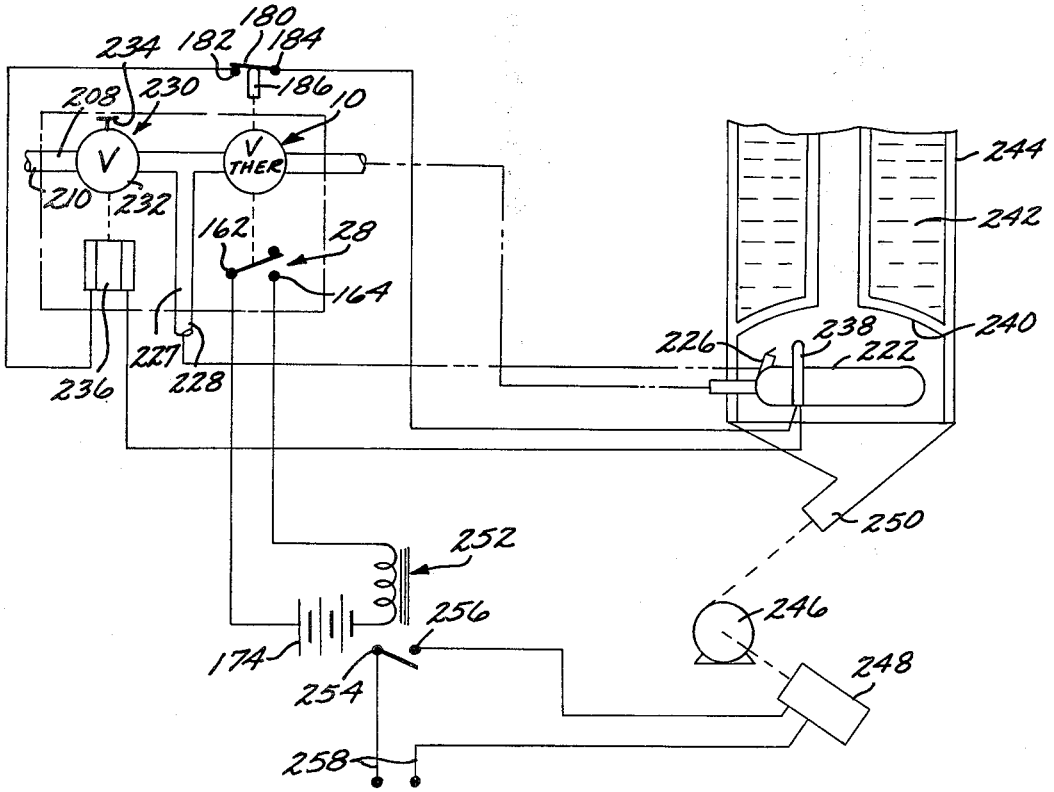

SNAP ACTING THERMOSTATIC FLUID VALVE AND ELECTRICAL SWITCH COUPLED THERETO

BACKGROUND OF THE INVENTION

The present application is a continuation of U.S. application Ser. No. 935,165 filed Aug. 21, 1978 and now abandoned.

Field of the Invention

The present invention relates to a thermostatically controlled valve and electrical switching devices.

Description of the Prior Art

Gas fired water heaters commonly have an externally mounted gas control valve with a thermostatic bimetallic, coaxial tube and rod which project into the water tank. The outer tube is secured to the tank and the gas valve housing, and the rod is secured to the cantilevered end of the tube in the water heater and projects coaxially back within the tube into the housing. The rod is mechanically coupled to the valve closure member of the valve supplying gas to the main burner of an appliance. Differential expansion of the dissimilar tube and rod members effectuates opening and closing of a valve closure member.

Valve structures used in hot water heaters, furnaces, and the like usually employ a continuous pilot burner and a safety shut-off valve leading to both the pilot burner and the main burner which is resiliently biased to a closed position. The safety valve has a manual operator and an electromagnetic coil. The pilot burner flame heats a thermocouple and the thermocouple leads are connected to the electromagnetic pilot valve solenoid so that when the manual operator is depressed and gas is supplied to the pilot burner, ignition of the gas and resulting flame at the pilot burner heats the thermocouple to generate a sufficient electromotive force to retain the safety valve in its latched, open position Water heaters are often positioned within a dwelling and are provided with an open flue to exhaust the combustion products. Ambient heat within the dwelling is lost through this flue when the gas burner is not in operation. Accordingly, it is highly desirable to employ a system in which a flue damper will close to retain ambient heat unless the main burner is actuated.

Prior devices have coupled thermostatic actuators to operate gas valves and electrical switches coupled thereto in synchrony. However, the prior devices have involved a continuous mechanical coupling from the thermostatic actuator to the valve member and an electrical switch which is operated therwith. Problems occur in conventional systems of this type when the thermostatic actuator resides at a position corresponding to the threshold of valve and switch operation. In such conventional systems it is possible for the contact arms of the electrical switch to reside in such close proximity that a low level current passes through normally closed contacts. This occurs where the contact pads of the switch contact arms reside just barely apart. The problem is aggravated by dust or moisture in the ambient surroundings. Moreover, dust or moisture are frequently present in the environment of a water heater or furnace actuating valve, and such valves are inspected for proper operation very infrequently.

Furthermore, when the valve mechanism and electric switch are moved by a thermostatic actuator to threshold conditions of activation it is possible for the valve and the electric switch to be actuated out of synchronism if only a very small misadjustment exists. This can result in failure of the electric switch or valve to activate when it should, or in premature activation.

SUMMARY OF THE INVENTION

The present invention is a unitary assembly of a thermostatically controlled fluid valve and an electric switch operated together by the use of a snap acting member which is movable between alternate stable positions in response to movement of a thermostatic actuator. With the use of the snap acting member of the invention the electrical switch is operated positively to one of two bistable states. That is, the contacts in the switch are either "off" or they are "on". The contacts are prevented from dwelling at a threshhold of actuation or deactuation and intermediate positions of the switch contacts are avoided.

The movement of the thermostatic actuator can be multiplied to operate the snap acting member by employing a level arrangement in the housing. That is, one end of the lever is positioned on a fulcrum while the other end of the lever bears against a reciprocal button that acts against the snap acting member. The forced transmitting end of the thermostatic actuator is received within the valve housing and bears against the lever at an intermediate position to thereby move the button a greater distance than the forced transmitting end of the thermostatic actuator moves. Preferably the position of the fulcrum in the housing is also adjustable, so that the valve can be calibrated to cooperate with the thermostatic actuator.

A further feature of the valve actuator is a lever ring. The lever ring is positioned proximate to the snap acting member and includes a circular rim and radially inwardly extending cantilevered lever arms which are separated by a short distance at the center of the lever ring. The free extremities of the cantilevered arms bear against a reciprocal rod that bears against the valve closure member. A fulcrum button is provided with a diameter sufficiently large that the edges of the fulcrum button bear against the cantilevered arms of the lever ring at positions intermediate the free extremeties thereof and the circulr rim. This further multiplies the reciprocal movement imparted to the fulcrum button by the thermostatic actuator.

Preferably, the electric switch itself is fastened to the valve housing by adjustable securing devices which releasably secure the electric switch in a selected position of orientation relative to the housing. The distance between the valve port and the electric switch is thereby adjustably variable, so that actuation of the electric switch can be adjusted to the movement of the valve closure member.

The electrical switch of the invention can be placed in an electrical controlled circuit for actuation of electrical units such as a flue damper operator located in the flue of a hot water heater. Alternatively, or additionally, the ellectrical switch of the invention can be used to directly actuate an electrical ignitor for ignition of gas discharged from the gas valve. Other water heater and combustion chamber electrical control systems may also be connected in circuit with the electric switch of the valve mechanism according to the invention.

The invention may be described with greater clarity and particularity by reference to the accompanying drawings.

DESCRIPTION OF THE DRAWINGS

FIG. 1 is a sectional elevational view of the thermostatic gas control valve of the invention with the snap acting member in one of its stable positions.

FIG. 2 is an elevational detail showing the snap acting member of FIG. 1 in its allternate stable position.

FIG. 3 is a sectional detail of the lever ring of the invention taken along the lines 3—3 of FIG. 1.

FIG. 8 is a diagrammatic view of a water heater having a flue damper and employing the valve of the invention.

FIG. 9 is a diagrammatic view of a forced air water heater employing the valve of the invention.

DESCRIPTION OF THE EMBODIMENTS

Figure 4:
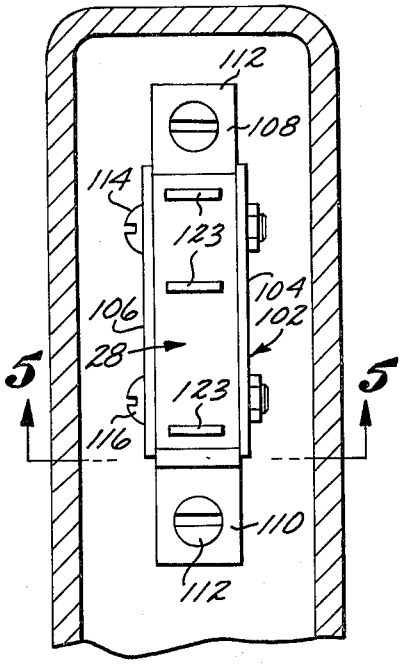
FIG. 4 is an elevational sectional detail of the electric switch of the invention taken along the lines 4—4 of FIG. 1.

FIG. 1 illustrates a thermostatic gas control valve mechanism 10 having a valve housing 12, an internal port 14, a valve closure member 16, and a spring 18 for urging the closure member 16 to seal the valve port 14. A thermostatic actuator 20 is secured to the housing 12 and has a force transmitting end 22 which is received within the housing 12. A snap acting member 24 is interposed between the thermostatic actuator 20 and the closure member 16. The snap acting member 24 is operable under the control of the thermostatic actuator 20 to move between alternate stable positions, depicted in FIGS. 1 and 2. A reciprocal rod 26 is interposed between the snap acting member 24 and the closure member 16. An electric switch 28 having a pushbutton actuator 30 is coupled to move with the valve closure member 16.

The conventional portions of the valve of the invention are substantially as described in U.S. Pat. No. 3,441,049. The valve housing 12 is a generally rectangular structure formed of iron or steel and having an inlet (not shown) leading to an inlet plenum 32 upstream of the valve port 14 and an outlet plenum 33 and an outlet 34 downstream therefrom. A generally cup shaped rectangular cover 36 is secured by machine screws to the housing 12 and serves to protect the electric switch 28.

The thermostatic actuator 20 is formed of an externally threaded shank 38 which is threadably engagable with a tapped bore in the wall of a conventional water heater. A backing plate 40 is secured to the threaded shank 38, and an internal tube 42 is secured at one end in fluid tight engagement to the interior of the shank 38. The tube 42 is the outer tube of the thermostatic actuator 20. The free end of the tube 42 (not shown) is attached to a coaxial, internal rod 44. The rod 44 is constructed of a dissimilar metal from the tube 42 so that the rod 44 and the tube 42 expand and contract by different amounts in response to temperature changes in water within the water heater. Water within the water heater surrounds the tube 42 when the shank 38 is threaded into the water heater. The rod 44, secured at its inner end to the inner extremity of the tube 42, extends in coaxial, cantilever fashion beyond the backing plate 40 and is received in the housing 12. The housing 12 of the valve mechanism 10 is securely attached to the backing plate 40 by machine screws.

Atop the housing 12 there is a conventional dial 46 coupled to a gas cock 48 within the housing 12 which is used to light the pilot of the hot water heater. Below the gas cock 48 the gas supply line empties into an inlet (not shown) to the housing 12 which leads to the inlet plenum 32. The inlet plenum 32 is separated from the outlet plenum 33 by the closure member 16 of the invention when the valve port 14 is closed.

The force transmitting end 22 of the thermostatic actuator 20 extends into the housing 12 and is received in a pocket 49 defined within an elongated lever 50. One end 51 of the lever 50 is disposed in contact with a reciprocal button 52 that has a broadened base defined with an interior overhanging shoulder that limits the movement of the button 52 to longitudinally reciprocal movement within the confines of a centrally apertured metal guide disc 54. The guid disc 54 bears against a flexible, fluid impervious membrane 58 that is located between the reciprocal button 52 and the snap actuating member 24. The impervious membrane 58 is of an overall disc shape and is sealed about its perimeter to a ledge in a laterally extending well in the interior structure of the housing 12, as depicted in FIGS. 1 and 2. The membrane 58 serves to prevent gas from either the inlet plenum 32, or the outlet plenum 33 from leaking past the reciprocal rod 26 and out of the housing 12.

Adjacent to the membrane 58 there is an annular, disc shaped plunger 60 having a central, axial aperture therein. Near the periphery of the plunger 60 there is an inwardly directed, raised circular bearing ridge 62 which resides in contact with the adjacent surface of the snap acting member 24. The snap acting member 24 is a thin, metal member with a small axial aperture at the center thereof. The snap acting member 24 is confined within the lateral well in the housing 12 so that when pressed toward the left by the bearing ridge 62 of the plunger 60, the snap acting member 24 bows toward the left and assumes the stable position of FIG. 2. When released, the bias of the spring 18 will force the snap acting member 24 to reverse its orientation and bow toward its right to its alternate stable position, depicted in FIG. 1.

To the left of the snap acting member 24 there is a fulcrum button 64 that has a broad circular base and a narrow, axial stub that extends through the aperture in the snap acting member 24. To the left of the fulcrum button 64 there is a lever ring 66, depicted in elevation in FIG. 3. The lever ring 66 is seated in the internal well in the housing 12 against a retaining ring 74. The lever ring 66 has a circular rim 68 and radially inwardly directed lever arms 70. The lever arms 70 are held in cantilever fashion from the rim 66, and the inwardly directed free extremities 72 of the lever arm 66 are aligned for contact with the adjacent axial extremity of the reciprocal rod 26.

As best illustrated in FIG. 2, the broad base of the fulcrum button 64 bears against the lever arms 70 intermediate the free extremities 72 thereof and the rim 68, to thereby multiply the motion of displacement of the snap acting member 24 as it moves between its alternate stable positions of FIGS. 1 and 2. In this way the portion of the lever arms 70 between the points of contact by the edges of the base of the fulcrum button 64 and the inner extremities 72 of the fulcrum arms 70 serve as distance multiplying members to increase the distance of movement of the reciprocal rod 26 beyond the distance imparted by the movement of the snap acting member 24.

The reciprocal rod 26 slides within a cylindrical passageway internally defined by a sleeve 75 within the structure of the valve housing 12. The housing 12 also provides a circular valve seat 78 against which the closure member 16 is brought to bear under the influence of the conical biasing spring 18. The biasing spring 18 forces the closure member 16, constructed of a composite of disc shaped members, into sealing engagement with the valve seat 78. When the reciprocal rod 26 is moved to the left by the snap acting member 24, as viewed in FIG. 2 by the force applied by the free extremity 72 of the lever arm 70, it moves the valve closure member 16 against the bias of the spring 18 likewise moved to the left to unseal the valve port 14. When the snap acting member moves to the position of FIG. 1, the reciprocal rod 26 allows the closure member 16 to close the valve port 14.

The spring 18 is seated within a guide boss 80 located within another lateral well defined in the structure of the housing 12. The guide boss 80 has a central axial aperture which receives a piston 82 that has a disc shaped base secured to a flexible, fluid impervious diaphragm 84 located between the valve closure member 16 and the pushbutton actuator 30 of the electric switch 28. The diaphragm 84 thereby serves as a means for preventing gas leakage from the housing 12 through the aperture in the housing 12 within which the electric switch pushbutton 30 reciprocates.

An elongated rod 90 is threadably engagable at 92 in a tapped bore in the structure of the housing 12. The rod 90 extends parallel to the path of movement of the reciprocal button 52 and the reciprocal rod 26. The rod 90 has an outer end 94 that is manually rotatable, when the electric switch cover 36 is removed, to advance and withdraw the rod 90 from the housing 12. The inner end of the rod 90 includes a cylindrical portion 96 of narrowed diameter that can be advanced and withdrawn within a sleeve 98. The inner tip 100 of the end 96 forms a fulcrum 100 for the lever 50 and protrudes into a cup shaped recess in the end 97 of the lever 50. The lever 50 extends transversely to the path of movement of the button 52 and the thermostatic actuating rod 44.

By threadably engaging and disengaging the rod 90 in the housing 12, the position of the fulcrum 100 can be varied to vary the distance which the button 52 is depressed by expansion of the thermostatic actuating rod 44 acting through its tip 22. That is, advancement of the rod 90 to increase the degree of threaded engagement with the housing 12 will move the fulcrum 100 to the right, as viewed in FIG. 1. This increases the extent to which the button 52 is depressed at a particular position of the inner end 22 of the thermostatic actuating rod 44. Conversly, by threadably disengaging the rod 90 from the housing 12, the fulcrum 100 can be moved to the left to decrease the extent to which the button 52 is depressed by the lever 50 at a given degree of expansion of the thermostatic rod 44.

Figure 5:
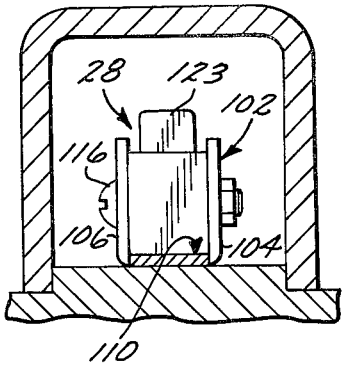
FIG. 5 is a sectional detail taken along the lines 5—5 of FIG. 4.

The electric switch 28 is fastened to the housing 12 by means of a saddle shaped electric switch mounting bracket 102, depicted in FIGS. 1, 4 and 5. The mounting bracket 102 defines a channel with opposing walls 104 and 106, between which the electric switch 28 is positioned, as depicted in FIGS. 4 and 5. End flanges 108 and 110 extend from the channel defined between the walls 104 and 106. The flanges 108 and 110 are secured to the housing 12 by means of machine screws 112.

The channel walls 104 and 106 have aligned pairs of apertures 118 and 120 therethrough separated in a direction transverse to the direction of movement of the reciprocal rod 26 and adapted to receive screws 114 and 116, depicted in FIG. 4. One of the pairs of apertures, depicted at 118 in FIG. 1, is remote from axial alignment with the reciprocal rod 26. The other of the pair of apertures in the walls 104 and 106, indicated at 120 in FIG. 1, is proximate to axial alignment with the reciprocal rod 26.

The electric switch 28 is constructed with an encompassing plastic body 121, from which the pushbutton actuator 30 protrudes on one side and electrical contact terminals 123 protrude on the other. The plastic body 121 of the electrical switch 28 has a circular aperture 122 therethrough which is aligned with the apertures 118 in the channels walls remote from axial alignment with the reciprocal rod 26. The plastic body 121 of the switch 28 also includes an arcuate aperture 124 therethrough. The arcuate aperture 124 is aligned with the apertures 120 in the channel walls proximate to axial alignment with the reciprocal rod 26.

The screws 114 and 116 form adjustable securing devices for releasably securing the electric switch 28 in a selected position of orientation relative to the housing 12. The releasable screws 114 and 116 extend through the apertures 118, 120 in the channel walls 104 and 106 through the apertures 122 and 124 in the electric switch 28. When the screws 114 and 116 are loosened slightly, the body of the electric switch 28 can be rotated slightly about the shank of the screw 114 within the limits defined by the ends of the arcuate aperture 124. This varies the orientation of the electric switch 26 within the mounting bracket 102. When a selected distance between the valve port 14 and the surface of the body 121 of the electric switch 28 aligned therewith is achieved, the screws 114 and 116 are tightened. By adjusting the distance between the valve port 14 and the body 121 of the electric switch 28, the switch 28 can be calibrated so that movement of the snap acting member 24 to the position of FIG. 1 will bring the internal electric switch contacts into either an "on" or an "off" condition, and movement of the snap acting member 24 to the position of FIG. 2 will bring the switch contacts to the opposite position.

A further form of calibration of the switch 28 is provided by the manner of mounting the bracket 102 on the housing 12. As illustrated in FIG. 1, the channel of the mounting bracket 102 spans a cavity 130 in the housing 12 and the end flanges 108 and 110 extend from the channel. The machine screws 112 serve as fasteners to secure the bracket 102 to the housing 112 intermediate the extremeties of the flanges 108 and 110. A rib 132 on the housing 12 contacts the extremity of at least one of the flanges, the flange 110 in the embodiment depicted. One of the screws 112 is located proximate to the extremity of the flange 110 where it contacts the rib 132 and passes through the cavity 130 into the housing 12. The screw 112 through the flange 110 is tightenable to deform the extremity of the flange 110 in contact with the rib 132 to thereby selectively vary the orientation of the channel of the bracket 112 relative to the cavity 130. That is, the screw 112 through the flange 110 can be tightened to vary the generally vertical orientation of the body of the switch 28 from that depicted in FIG. 1. This will bring the surface of the switch body 121 which is aligned with the valve port 14 slightly toward the valve port 14. This alters the position to which the switch pushbutton actuator 30 moves the internal switch contacts, so as to vary the switch contacts between "off" and "on" conditions with movement of the snap acting member 24.

Figure 6:
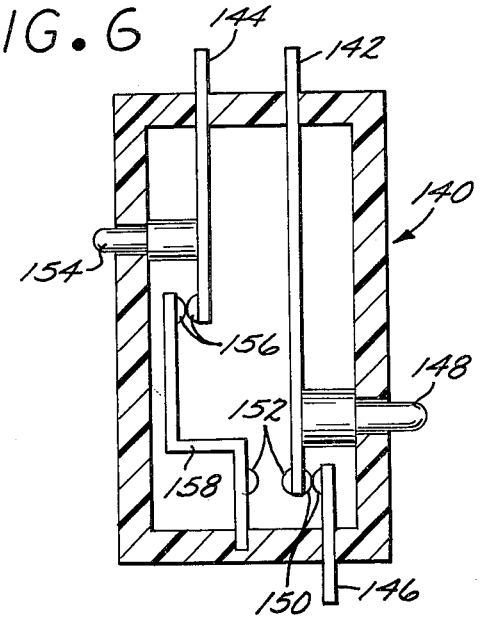
FIG. 6 is a sectional elevational view of an alternative embodiment of an electric switch construction.

FIG. 6 illustrates an alternative construction of the switch of the invention, designated as a switch 140. The switch 140 has terminals 142, 144 and 146 emanating therefrom. The pushbutton actuator 148, which moves in response to movement of the thermostatic actuator 20, allows contacts 150 to remain closed when the spring 18 biases the closure member 16 to seal the port 14. This occurs when the snap actuating member 24 is in the position depicted in FIG. 1. When the snap actuating member 24 moves to its alternate stable position, depicted in FIG. 2, the normally open contacts 152 are closed and the normally closed contacts 150 are opened.

The switch 140 includes a manually operable pushbutton 154 which when depressed, opens normally closed contacts 156. The pushbutton 154 bears against the resilient cantilevered electrical terminal 144 that is biased toward a fixed position terminal 158 to normally close the contact pads 156 and establish an electrical circuit therethrough. The electrical terminal 158 also carries the fixed position contact 152 opposite the mating moving contact 152 on the end of resilient interior portions of the terminal 142. The interior portion of the terminal 142 is moved by the push rod 148 that is mechanically linked to the valve closure member 16 of the thermostatic control valve 10 which supplies gas to the main burner. This gas valve is positioned in response to the thermostatic actuator 20 using the snap acting member 24, previously described.

Figure 7:
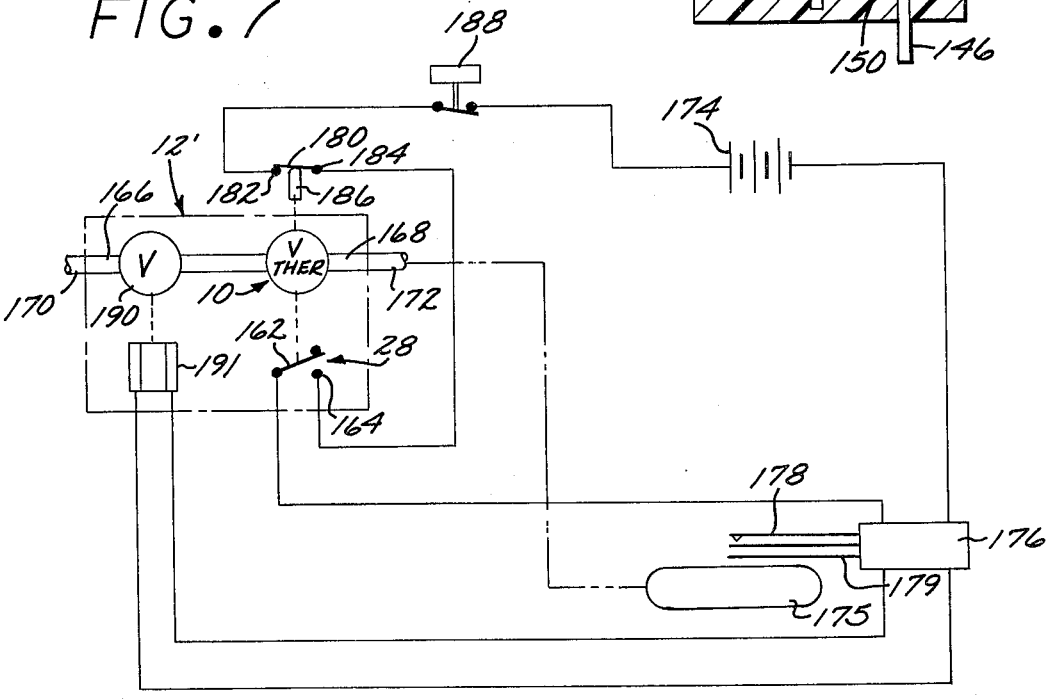
FIG. 7 is a diagrammatic view of a direct ignition water heater control system employing the valve of the invention.

FIG. 7 illustrates an application of the invention to a control system for a direct ignition gas fired water heater. The thermostatic gas control valve 10 is utilized in the system and is shown in the phamptomed housing 12', which houses the functional components shown in FIG. 1. The housing 12' includes the thermostatically actuated gas control valve mechanism 10, including the electric switch 28. The electric switch 28 has electrical contacts 162 and 164, which are normally open. The housing 12 has an inlet 166 on one side of the valve port 14 of FIG. 1 and an outlet 168 on the other side thereof. A gas supply conduit 170 is coupled to the inlet 166 and a gas burner conduit 172 terminating in a gas burner 75 is coupled to the outlet 168. An enabling electrical voltage supply, illustrated as a battery 174, is coupled to a conventional ignitor circuit 176 having a spark electrode 178 for ignition of gas discharged through the gas burner conduit 172 to the burner 175. The ignitor circuit 176 is electrically connected to the voltage supply 174 through the normally open contacts 162 and 164 of the electric switch 28.

A thermostatic switch 180 with normally closed contacts 182 and 184 is connected in circuit with the normally open contacts 162 and 164 of the electric switch 28, the voltage supply 174, and the ignitor circuit 176. The thermostatic contacts 182 and 184 are operable by the thermostat 186 to open when the thermostat 186 is heated above a predetermined safe temperature.

In normal use the thermostatc gas control valve mechanism 10 is applied to a gas fired water heater and the thermostatic actuator 20 of FIG. 1 is positioned within the water heater and senses the temperature of water in the water heater. The thermostat 186 is also positioned in thermal contact with water in the water heater to sense the temperature thereof. Indeed, the functions of the thermostatic actuator 20 and the thermostat 186 may be performed by a single device.

The spark ignitor circuit 176 is a direct ignition system similar to that employed in U.S. Pat. No. 3,853,455 having spark electrodes 178 and a flame rectification electrode 179. A manual interruption switch 188 can be used to manually interrupt the circuit. The circuit of FIG. 7 also includes a preliminary valve 190 upstream of the thermostatic valve control mechanism 10. The valve 190 is provided with a solenoid coil 191 which can open the valve 190 in response to an applied direct voltage.

The gas valve mechanism 10 of the invention can also be used in a control system for water heater having a flue 192 above a gas burner and a mechanically actuated flue damper 194 mounted in the flue. A spring 196 biases the flue damper 194 to a normally open position. The secondary 197 of a transformer 198 serves as an enabling electrical power supply. A motor 200 is mechanically coupled to close the damper 194 and is electrically connected in circuit to the enabling electrical secondary 197 of the transformer 198 and to normally closed contacts 202 and 204 of the electric switch 28. The contacts 204 and 214 of the switch 28 are normally open.

The valve housing 12" has an inlet 206 on one side of the valve port of the thermostatically operated valve mechanism 10 and an outlet 208 on the other side thereof. A gas supply conduit 210 is coupled to the inlet 206 and a main gas burner conduit 212 is coupled to the outlet 208.

The systm also employs a solenoid valve mechanism 216 having a solenoid valve 218 and an electrical coil 220 for operating the valve 218. The solenoid valve mechanism 216 is located in the outlet 208 between a main gas burner 222 and a valve housing outlet 208. The solenoid valve mechanism 216 includes an electrical circuit that connects the coil 220 of the solenoid valve mechanism 216 to the secondary 197 of the transformer 198 through the normally open contacts 202 and 214 of the electric switch 28.

The circuit also includes a flue switch 223 in circuit between the solenoid coil 220 and the secondary 197 of the transformer 198. The flue switch 323 is mechanically linked to the flue damper 194 to close when the flue damper is in its open position.

The main gas burner 222 is supplied with gas through the line 212. A pilot burner 226 is supplied with gas through conduit 228. Conduit 228 extends to a pilot outlet 227 in the housing 12" of the gas valve mechanism 10 of the invention. The pilot outlet 227 is connected between the inlet 206 to the housing 12" and the valve port 14 of the gas valve mechanism 10 of the invention. Between the connection of the pilot outlet 227 and the inlet 206, there is a pilot solenoid valve mechanism 230. The pilot solenoid valve mechanism 230 includes a normally closed pilot valve 232 coupling the inlet 206 to the pilot outlet 227. The pilot valve 232 includes a manually operable gate 234 for opening the pilot valve 232. The pilot solenoid valve mechanism 230 also includes an electrical solenoid coil 236 for maintaining the pilot valve 232 open.

A thermocouple 238 is located at the pilot burner 226 and is responsive to a flame at the pilot burner. When heated by the pilot burner 226, the thermocouple 238 generates a small electric current sufficient to power the pilot solenoid coil 236 and maintain the pilot valve 232 in an open condition.

Once the manual gate 234 has been actuated to supply gas to the pilot conduit 228, and the pilot burner 226 has been lit and the thermocouple 238 heated for about one minute, the current generated by the thermocouple 238 powers the pilot solenoid coil 236 to hold the armature (not shown) retracted and the valve 232 open. A thermostat 186 having a switch 180 with normally closed contacts 182 and 184 is located in circuit with the thermocouple 238. The solenoid coil 236 is coupled in series to the thermostatic switch 180 which is controlled by a thermostat 186 and immersed in the water tank. As long as the thermocouple 238 generates current and the system does not exceed a maximum temperature, governed by the thermostat 186, the pilot valve 232 will be held open and the pilot burner 226 will remain on.

Until there is a call for heat from the thermostat 186, the port 14 in the gas valve mechanism 10 of the invention will remain closed. The secondary 197 of the transformer 198 thereby drives the motor to close the damper 194, overcoming the bias of spring 196. This opens the flue switch 222. With a call for heat from the thermostat 186, the normally closed switch contacts 204 and 202 of the electric switch 28 are opened, and the normally open contacts 204 and 214 are closed. This breaks the circuit supplying power to the motor 200, and the spring 196 opens the flue 194 and closes the flue switch 223. The solenoid coil 220 is thereupon supplied with power to hold the valve 218 open to supply gas to the main burner 222.

With the arrangement of FIG. 8, the flue 192 will remain open while the main burner 222 remains on, and will close when the main burner 222 goes off. This prevents the loss of ambient heat through the flue 192 when the main burner 222 is off.

FIG. 9 illustrates a solenoid and thermostatic actuated gas valve mechanism arrangement similar in some respects to the arrangement of FIG. 7. However, in the configuration of FIG. 9 there is a combustion chamber 240 beneath an annular water chamber 242 of a water heater 244, and the combustion chamber 240 is supplied with a forced draft. The draft is created by an air blower 246 driven by an electric motor 248. The air blower 246 forces air into the combustion chamber 240 through a duct 250. As in the embodiment of FIG. 8, a main burner 222, thermocouple 238 and pilot burner 226 are located in the combustion chamber 240. A battery 174 supplies voltage to the normally open contacts 162 and 164 of the switch 28. When the thermostat 186 operates the valve mechanism 10, the normally open contacts 162 and 164 are closed. A circuit is thereby completed so that the battery 174 operates a relay 252 to close normally open switch contacts 254 and 256 in an electrical circuit supplied with power on lines 258. With the closure of contacts 254 and 256, the motor 248 is actuated to drive the blower 246 to force air through the duct 250 into the combustion chamber 240.

It should be understood that numerous variations and modifications of the invention may be achieved without departing from the scope of the invention. Accordingly, the scope of the invention should not be construed as limited to the specific embodiments depicted, but rather as defined in the claims appended hereto.

We claim:

1. A thermostatic gas control valve mechanism comprising a valve housing having an internal valve port, a valve closure member, biasing means interposed between said closure member and said housing urging said closure member to seal said internal valve port, a thermostatic actuator secured to said housing with a force transmitting end received within said housing and coupled to act in opposition to said biasing means, a snap acting member interposed between said thermostatic actuator and said closure member and operable by said thermostatic actuator and said biasing means to move between alternate stable positions, a reciprocal rod interposed between said snap acting member and said closure member to drive said closure member against the bias of said biasing means to unseal said valve port when said snap acting member is in one of its stable positions and to allow said closure member to close said internal valve port when said snap acting member is in an alternative stable position, and electric switch having a pushbutton actuating means coupled to move with said valve closure member, adjustable securing means for securing said electric switch to said housing, and said securing means for releasably securing said electric switch in a selected position and orientation relative to said housing, whereby the distance between said valve port and said electric switch is adjustably variable, a saddle shaped electric switch mounting bracket defining a channel with opposing walls between which said electric switch is positioned, wherein end flanges extend from said channel and are secured to said housing, and said channel walls have aligned pairs of apertures therethrough separated in a direction transverse to the direction of movement of said reciprocal rod, and one of said pairs of apertures is remote from axial alignment with said reciprocal rod and the other pair of apertures is proximate to axial alignment with said reciprocal rod, and said electric switch includes an encompassing body which has a circular aperture therethrough aligned with said apertures in said channel walls remote from axial alignment with said reciprocal rod and an arcuate aperture therethrough aligned with said reciprocal rod and an arcuate aperture therethrough aligned with said apertures in said channel walls proximate to axial alignment with said reciprocal rod, and wherein said adjustable securing means are releasable fasteners which extend through said apertures in said channel walls and through said body of said electric switch, whereby the rotational orientation of said electric switch in said switch mounting bracket is adjustable within limits defined by said arcuate aperature.

2. A thermostatic gas control valve mechanism comprising a valve housing having an internal valve port, a valve closure member, biasing means interposed between said closure member and said housing and urging said closure member to seal said internal valve port, a thermostatic actuator secured to said housing with a force transmitting end received within said housing and coupled to act in opposition to said biasing means, a snap acting member imposed between said thermostatic actuator and said closure member and operable by said thermostatic actuator and said biasing means to move alternate stable positions, a reciprocal rod interposed between said snap acting member and said closure member to drive said closure member against the bias of said biasing means to unseal said valve port when said snap acting member is in one of its stable positions and to allow said closure member to close said internal valve port when said snap acting member is in an alternative stable position, and electric switch having a pushbutton actuating means coupled to move with said valve closure member, adjustable securing means for securing said electric switch to said housing, and wherein said securing means releasably secures said electric switch in a selected position of orientation relative to said housing, whereby the distance between said valve port and said electric switch is adjustably variable, a saddle shaped electric switch mounting bracket defining a channel with opposing walls between which said electric switch is positioned, and said channel spans a cavity in said housing and end flanges extend from said channel, and fasteners secure said bracket to said housing intermediate the extremities of said flanges and rib on said flanges, and one of said fasteners is located proximate thereto and passes through said cavity into said housing and is tightenable to deform the extremity of said flange in contact with said rib to thereby selectively vary the orientation of said channel relative to said cavity.

3. A thermostatic gas control valve mechanism comprising:

a valve housing having an inlet port, and outlet port, and internal valve port, a valve closure member, biasing means interposed between said closure member and said housing and urging said closure member to seal said internal valve port, a thermostatic actuator secured to said housing with a force transmitting end received within said housing and coupled to act in opposition to said biasing means, a snap acting member interposed between said thermostatic actuator and said closure member and operable by said thermostatic actuator and said biasing means to move between alternate stable positions, a reciprocal rod interposed between said snap acting member and said closure member to drive said closure member against the bias of said biasing means to unseal said valve port when said snap acting member is in one of its stable positions and to allow said closure member to close said internal valve port when said snap acting member is in an alternative stable position;

an electric switch having a pushbutton actuating means coupled to move with said valve closure member and including a pair of normally closed contacts and a manually operable pushbutton which when depressed opens said normally closed contacts;

auxiliary circuit means for performing an operation auxiliary to the flow of gas through said valve housing, said auxiliary circuit means being electrically coupled to said switch and activated through said switch, whereby auxiliary operations including activation of a blower, flue damper and electric burner igniter may be controlled by said gas control valve mechanism.

4. A thermostatic gas control valve mechanism comprising a valve housing having an inlet port, an outlet port, and an internal valve port, a valve closure member, biasing means interposed between said closure member and said housing and urging said closure member to seal said internal valve port, a thermostatic actuator secured to said housing with a force transmitting end received within said housing and coupled to act in opposition to said biasing means, a snap acting member interposed between said thermostatic actuator and said closure member and operable by said thermostatic actuator and said biasing means to move between alternate stable positions, a reciprocal rod interposed between said snap acting member and said closure member to drive said closure member against the bias of said biasing means to unseal said valve port when said snap acting member is in one of its stable positions and to allow said closure member to close said internal valve port when said snap acting member is in an alternative stable position;

an electric switch having a pushbutton actuating means coupled to move with said valve closure member; said electric switch has normally open electric contacts and said housing has an inlet on one side of said valve port and an outlet on the other side thereof;

a gas supply conduit coupled to said inlet;

a gas burner conduit terminating in a gas burner coupled to said outlet;

an enabling electrical voltage supply; and an igniter circuit and spark electrode for ignition of gas discharged through said gas burner conduit from said burner electrically connected in circuit to said electrical voltage supply in circuit through normally open electric contacts of said electric switch.

5. A gas valve mechanism according to claim 4 further comprising a thermostatic switch with normally closed contacts in circuit with said normally open contacts of said electric switch, said voltage supply and said igniter circuit and operable to open when said thermostatic switch is heated above a predetermined safe temperature.

6. A gas valve mechanism according to claim 5 applied to a gas fired water heater wherein said thermostatic actuator is positioned within said water heater and senses the temperature of water in said water heater.

7. A gas valve mechanism according to claim 6 wherein said thermostatic actuator operates said thermostatic switch.

8. A thermostatic gas control valve mechanism comprising:

a valve housing having an inlet port, an outlet port, and an internal valve port;

a valve closure member;

biasing means interposed between said closure member and said housing and urging said closure member to seal said internal valve port;

a thermostatic actuator secured to said housing with a force transmitting end received within said housing and coupled to act in opposition to said biasing means;

a snap acting member interposed between said thermostatic actuator and said biasing means to move between alternate stable positions;

a reciprocal rod interposed between said snap acting member and said closure member to drive said closure member against the bias of said biasing means to unseal said valve port when said snap acting member is in one of its stable positions and to allow said closure member to close said internal valve port when said snap acting member is in an alternative stable position;

an electric switch having a pushbutton actuating means coupled to move with said valve closure member;

adjustable securing means for securing said electric switch to said housing, said securing means releasably securing said electric switch in a selected position of orientation relative to said housing whereby the distance between said valve port and said electric switch is adjustably variable;

auxiliary circuit means for performing an operation auxiliary to the flow of gas through said valve housing, said auxiliary circuit means being electrically coupled to said switch and activated through said switch whereby auxiliary operations, including activation of a blower, flue damper and electric burner igniter, may be controlled by said gas control valve mechanism; and a saddle shaped electric switch mounting bracket defining a channel with opposing walls between which said electric switch is positioned, and end flanges extending from said channel and secured to said housing, said channel walls having aligned pairs of apertures therethrough separated in a direction transverse to the direction of movement of said reciprocal rod, one of said pairs of apertures being remote from axial alignment with said reciprocal rod, said electric switch including an encompassing body having a circular aperture therethrough aligned with said apertures in said channel walls remote from axial alignment with said reciprocal rod, and further having an arcuate aperture therethrough aligned with said apertures in said channel walls proximate to axial alignment with said reciprocal rod, said adjustable securing means being releasable fasteners which extend through said apertures in said channel walls and through said body of said electric switch, whereby the rotational orientation of said electric switch in said switch mounting bracket is adjustable within limits defined by said arcuate aperture.

9. A thermostatic gas control valve mechanism comprising:

a valve housing having an inlet port, an outlet port, and an internal valve port;

a valve closure member;

biasing means interposed between said closure member and said housing and urging said closure member to seal said internal valve port;

a thermostatic actuator secured to said housing with a force transmitting end received within said housing and coupled to act in opposition to said biasing means;

a snap acting member interposed between said thermostatic actuator and said biasing means to move between alternate stable positions;

a reciprocal rod interposed between said snap acting member and said closure member to drive said closure member against the bias of said biasing means to unseal said valve port when said snap acting member is in one of its stable positions and to allow said closure member to close said internal valve port when said snap acting member is in an alternative stable position;

an electric switch having a pushbutton actuating means coupled to move with said valve closure member;

adjustable securing means for securing said electric switch to said housing, said securing means releasably securing said electric switch in a selected position of orientation relative to said housing whereby the distance between said valve port and said electric switch is adjustably variable;

auxiliary circuit means for performing an operation auxiliary to the flow of gas through said valve housing, said auxiliary circuit means being electrically coupled to said switch and activated through said switch whereby auxiliary operations, including activation of a blower, flue damper and electric burner igniter, may be controlled by said gas control valve mechanism; and a saddle shaped electric switch mounting bracket defining a channel with opposing walls between which said electric switch is positioned, said channel spanning a cavity in said housing, end flanges extending from said channel, fasteners securing said bracket to said housing intermediate the extremities of said flanges, said housing having a rib contacting the extremity of at least one of said flanges, and one of said fasteners being located proximate thereto and passing through said cavity into said housing and being tightenable to deform the extremity of said flange in contact with said rib to thereby selectively vary the orientation of said channel relative to said cavity.

10. An improvement in a thermostatic gas control valve mechanism including a valve housing, an internal valve port, a value closure member, biasing means interposed between said valve closure member and said housing for urging said closure member to seal said internal valve port and configured to travel toward and away from said valve closure member, a thermostatic actuator secured to said housing with a force transmitting end received within said housing and coupled to active opposition to said biasing means, a snap acting member interposed between said thermostatic actuator and said closure member and operable by said thermostatic actuator and said biasing means to move between two alternate stable positions, a reciprocal rod interposed between said snap acting member and said closure member to drive said closure member against the bias of said biasing means to unseal said valve port when said snap acting member is in one of its said alternate stable positions and to allow said closure member to close said internal valve port when said snap acting member is in the other one of said two alternative stable positions, and an electric switch having a pushbutton actuating means engaged by said biasing member to move said biasing member and in turn said closure member, reciprocal rod and said snap acting member, said improvement comprising:

adjustable securing means for securing said electric switch to said housing in a selective position and orientation so that said pushbutton actuating means of said electric switch is engaged by said biasing means only after a calibrated amount of travel of said biasing means, whereby said snap acting member moves between said one of said two alternate stable positions to said other one of said alternate stable positions and in turn moves said reciprocal rod, closure member and biasing means towards said pushbutton of said electric switch, the distance of said calibrated amount of travel between said pushbutton and said biasing means selected through adjustment of said adjustable securing means so that engagement between said pushbutton and biasing means occurs only after said snap acting member has transitioned beyond a predetermined degree from said one stable alternative position to said other stable alternative position so that resistive force exerted on said biasing means by said pushbutton and in turn through said closure member to said snap acting member does not prevent the transition of said snap acting member between said two stable alternative positions.

* * * * *

UNITED STATES PATENT AND TRADEMARK OFFICE

CERTIFICATE OF CORRECTION

PATENT NO. : 4,422,844

DATED : December 27, 1983

INVENTOR(S) : Marvin M. Graham and Jay R. Katchka

It is certified that error appears in the above—identified patent and that said Letters Patent is hereby corrected as shown below:

Column 2, line 28, after "than" insert --that moved by--;

line 29, delete "moves" and insert --.--;

Column 2, line 60, delete "ellectrical" and insert --electrical--;

Column 3, line 7, delete "allternate" and insert --alternate--;

Column 4, line 21, delete "guid" and insert --guide--;

Column 6, line 54, delete "112" and insert --12--;

line 64, delete "112" and insert --102--;

Column 8, line 33, delete "systm" and insert --system--; and

Column 9, line 23, delete "222" and insert --223--.

Signed and Sealed this

*Fourteenth* Day of *August 1984*

[SEAL]

*Attest:*

GERALD J. MOSSINGHOFF

*Attesting Officer*

*Commissioner of Patents and Trademarks*